United States Patent [19]

Parsons

[11] Patent Number: 4,909,206

[45] Date of Patent: Mar. 20, 1990

[54] INTERNAL COMBUSTION ENGINES

[75] Inventor: Bryan N. V. Parsons, Stoney Stanton, United Kingdom

[73] Assignee: Jaguar Cars Limited, United Kingdom

[21] Appl. No.: 347,410

[22] Filed: May 4, 1989

[30] Foreign Application Priority Data

May 5, 1988 [GB] United Kingdom ..... 8810573

[51] Int. Cl.[4] ..... F02B 75/32

[52] U.S. Cl. ..... 123/197 R; 123/58 R

[58] Field of Search ..... 123/197 R, 197 AC, 57 R, 123/58 R, 51 R

[56] References Cited

U.S. PATENT DOCUMENTS

| | | | |
|---|---|---|---|
| 1,681,072 | 8/1928 | Watts | 123/197 R |
| 3,370,510 | 2/1968 | Bunyan | 123/197 R |
| 3,939,809 | 2/1976 | Rohs | 123/197 AC |
| 4,112,826 | 9/1978 | Cataldo | 123/197 AC |
| 4,270,495 | 6/1981 | Freudenstein et al. | 123/197 AC |
| 4,827,896 | 5/1989 | Adams | 123/197 AC |

FOREIGN PATENT DOCUMENTS

| | | | |
|---|---|---|---|
| 738713 | 7/1943 | Fed. Rep. of Germany | 123/197 AC |
| 2602436 | 7/1977 | Fed. Rep. of Germany | 123/197 AC |
| 1129801 | 10/1968 | United Kingdom . | |
| 1554357 | 10/1979 | United Kingdom . | |

*Primary Examiner*—David A. Okonsky

*Attorney, Agent, or Firm*—Davis, Bujold & Streck

[57] ABSTRACT

An internal combustion engine includes a beam mounted on a central pivot, at least two pistons are each slidably located in a cylinder to act on an opposite end of the beam, said beam defining a cradle, a bearing is mounted within the cradle upon a pair of trunnions about which the bearing may pivot, the pivot axis of the bearing being at right angles to the pivot axis of the beam, these pivot axes lying within a common plane which is transverse to the axes of the cylinders, a crank shaft with angled crank pil-0s mounted for rotation about an axis which extends longitudinally of the cylinders and passes through the point of intersection of the pivot axes of the bearing and beam, the crank pin being located in the bearing.

13 Claims, 5 Drawing Sheets

INTERNAL COMBUSTION ENGINES

BACKGROUND OF THE INVENTION

The present invention relates to internal combustion engines.

SUMMARY OF THE INVENTION

According to one aspect of the present invention an internal combustion engine includes a beam mounted on a central pivot, a pair of pistons each slidably located in a cylinder, each piston acting on an opposite end of the beam, said beam defining a cradle, a bearing being mounted within the cradle upon a pair of trunnions about which the bearing may pivot, the pivot axis of the bearing being at right angles to the pivot axis of the beam, said pivot axes lying within a common plane which is transverse to the axes of the cylinders, a crank shaft with angled crank pin being mounted so that its axis of rotation extends longitudinally of the cylinders and passes through the point of intersection of the pivot axes of the bearing and beam, the crank pin being located in the bearing.

Generally the cylinders will be disposed parallel to one another with the crankshaft mounted for rotation centrally of the cylinders about an axis parallel to the axes of the cylinders, the axes of the cylinders and axis of rotation of the crankshaft being perpendicular to the plane containing the pivot axis of the beam and bearing. The cylinders may however be slightly inclined to the perpendicular. For example the cylinders may be inclined inwardly away from the beam, so that over the initial part of its power stroke each piston will apply a load to the beam in a direction substantially linearly of the axis of the cylinder. Even when inclined, the cylinders will generally be arranged symmetrically and the crankshaft disposed centrally so that it is perpendicular to the common plane of the pivot axes of the beam and bearing. The present invention is not however limited to symmetrical arrangements in which the crankshaft is perpendicular to the common plane including the pivot axes of the beam and bearing, but will also include asymmetrical arrangements and arrangements in which the crankshaft is slightly inclined to the perpendicular, as may be necessitated, for example, by space restraints or the positioning of other components.

Pivotting of the bearing at right angles to the beam will de-couple transverse movement of the crank pin from the beam, so that as the beam is rocked forwards and backwards under the action of the piston, the crank shaft will be rotated.

Conveniently the cradle may be formed of two parallel beams with a common pivot axis which are interconnected by cross members. Pistons may then be arranged to act on the opposite ends of each beam. Pistons on one side of the pivot will consequently move together in one direction while the pistons on the other side will move together in the opposite direction. In a four stroke engine, pistons on one side of the pivot would consequently be on the compression and exhaust stroke while those on the other side of the pivot are on the power and induction strokes and vice versa. With this arrangement, the crank bearing may then be pivotally mounted on trunnions which engage the cross members between the beams. The crank shaft will then extend parallel to the four cylinders, centrally thereof.

Two such banks of cylinders may advantageously be arranged back to back with the beam assemblies adjacent one another, but the pivot axis of one beam assembly being displaced at 90° to the other. A Z-crank may then be mounted in the bearings associated with the two banks of cylinders. Rocking of the beams applies a force to the crank shaft in the plane perpendicular to the pivot axis of the beams. This arrangement will consequently apply forces to the crank shaft at 90°, the power strokes of the pistons being timed to provide a substantially uniform power transfer to the shaft.

Conventional connecting-rods may be used to connect the pistons to the beams. As the connection with the beam will be at a relatively large radius from the pivot axis of the beam as compared to the radius of the crank on a conventional engine, there will be relatively small lateral displacement of the connection between the con-rod and the beam and consequently lateral forces between the piston and cylinder bore will be significantly reduced with consequent improvements in stability and wear. Alternatively, the pistons may be connected directly to the ends of the beam by means which will permit relative lateral movement therebetween. This lateral movement of the connection between the piston and beam may be used for pumping lubricant.

As the crank shaft of the engine described above extends parallel to and centrally of the cylinders, the configuration is particularly suitable for use with rotary valves which may be driven by means of a plate which is mounted on a crank on the crank shaft and is constrained to perform orbital movement by one or more idler cranks. One method of achieving this is disclosed in co-pending UK patent application No. 8720494.

BRIEF DESCRIPTION OF THE DRAWINGS

Various embodiments of the invention are now described, by way of example only, with reference to the accompanying drawings, in which.

DESCRIPTION OF A PREFERRED EMBODIMENT

Figure 1:
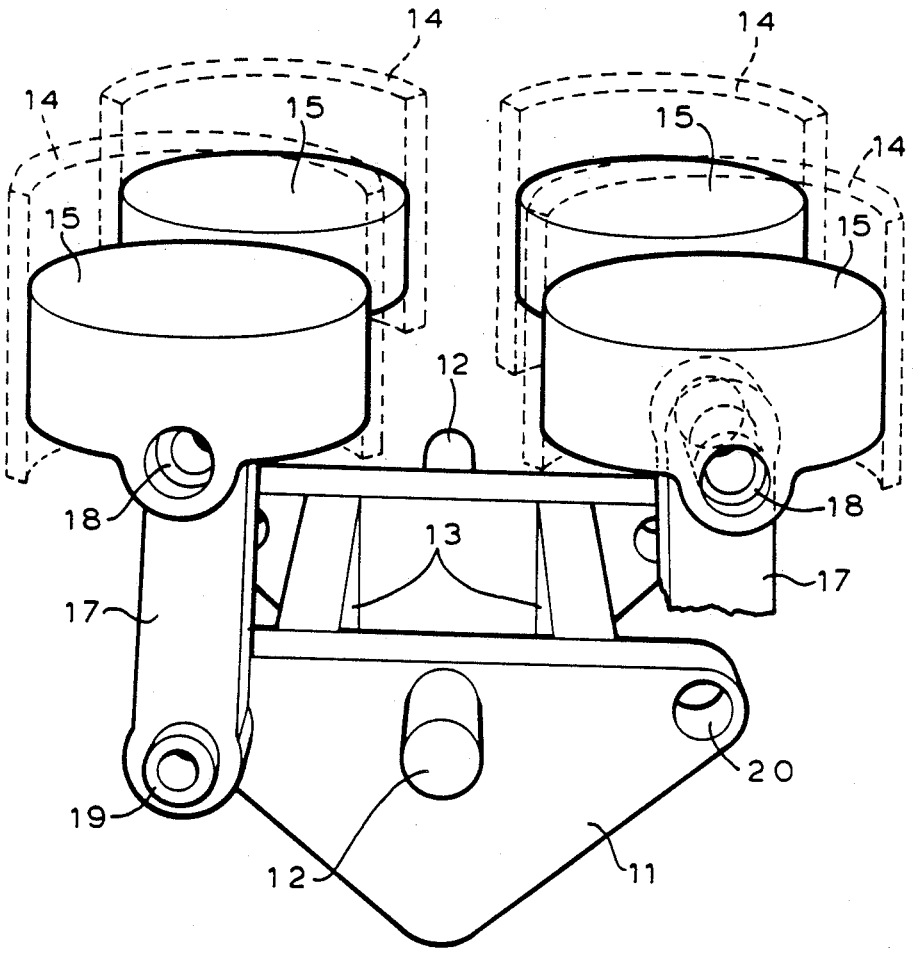
FIG. 1 is a perspective view illustrating the beam/piston assembly of a four cylinder engine formed in accordance with the present invention.

The engine illustrated in FIG. 1 as a pair of beams 11 which are mounted for pivotal movement about the common axis on pins 12 which locate in suitable bearings. The beams 11 are interconnected by a pair of cross members 13 which are spaced on either side of the pivot axis defined by pins 12. A piston 15 slidingly located in a cylinder 14 is connected to each end of each beam 11 by means of a con-rod 17. The con-rol 17 is pivotally connected to the piston 15 by means of a gudgeon pin 18, in conventional manner, and to the beam 11 by means of pin 19 which is located in a hole 20 in the end of beam 11.

Figure 2:
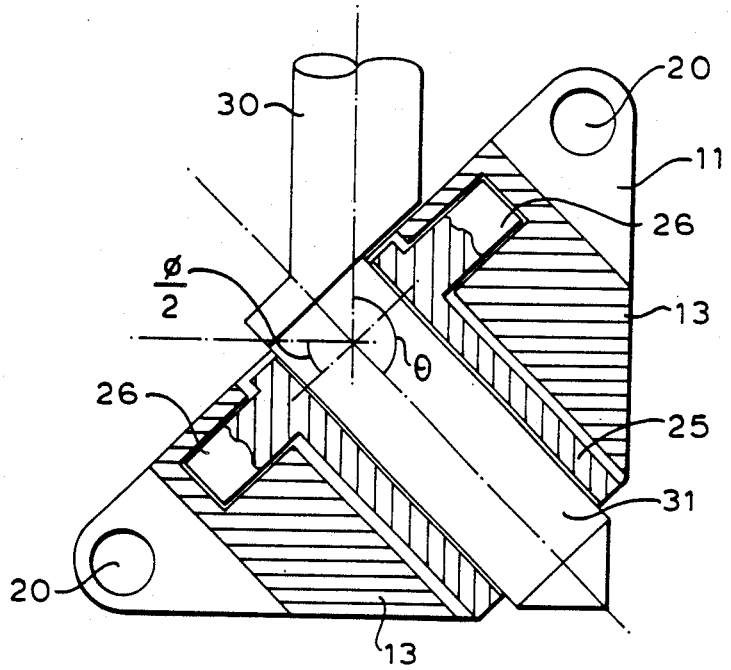
FIG. 2 is a part sectional view illustrating the beam/crank shaft assembly of the engine illustrated in FIG. 1.
Figure 3:
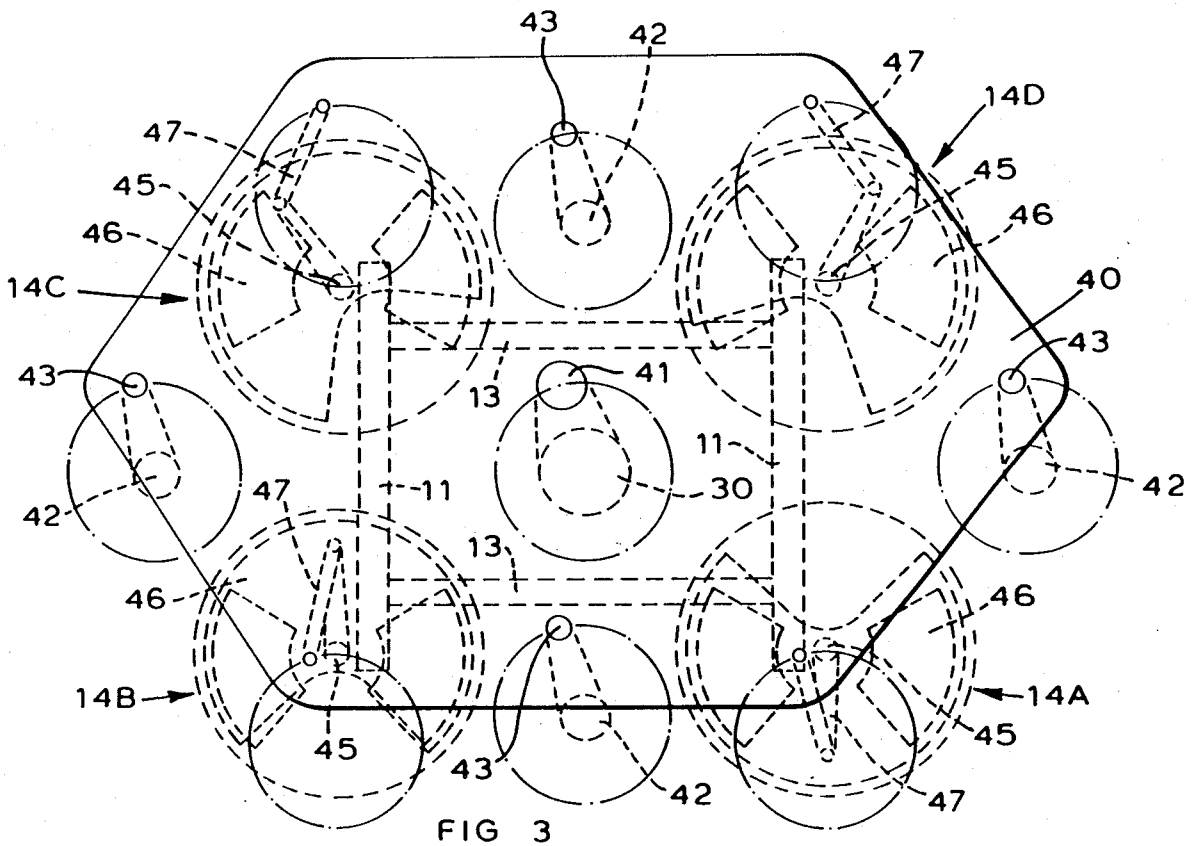
FIG. 3 illustrates the valve gear arrangement of the engine illustrated in FIG. 1.

As illustrated in FIG. 2, a bearing 25 is pivotally located between the cross members 13 by means of the pair of trunnions 26, located adjacent one end of bearing 25, said trunnions 26 engaging in bearings in the cross members 13. The bearing 25 is thus pivotally mounted with respect to the beams 11, the pivot axis of the bearing 25 being coplanar with the pivot axis of the beams 11 but at right angles thereto.

The crank shaft 30 is located in suitable bearings (not shown) so that it extends parallel to the cylinders 14, the axis of rotation of the crank shaft 30 passing through the point of intersection of the pivot axes of the beams 11 and bearing 25. An inclined crank 31 on the end of crank shaft 30 engages in the bearing 25. The angle of inclination $\theta$ of the crank 31 is supplementary to half the angle $\phi$ typically 70°-80° moved by the beam when the pistons 15 move between top dead centre and bottom dead centre; and the crank 31 is disposed parallel to the plane in which the beams 11 rock, when the pistons 15 are at top dead centre and bottom dead centre. At intermediate positions in the stroke of the pistons 15, the crank 31 will be inclined to the plane in which the beams 11 rock, the bearing 25 pivotting about trunnions 26 to accommodate this inclination. Maximum inclination of the crank 31 occurs when the pistons 15 are at the middle of their stroke. The pivotting of the bearing 25 in the manner disclosed will thereby decouple any transverse movement of the crank 31 relative to the plane in which the beams 11 rock, so that as the beams 11 are rocked by the action of the pistons 15, the crank shaft 30 will be rotated.

With the engine described above, movement of the pistons 15 will induce a rocking couple. This may be balanced by means of counter weights formed on both sides of the bearing 25 the centre of mass of the weights being disposed on an axis mutually perpendicular to the axis of trunnions 26 and the axis of the crank 31, as the beams 11 rock to and fro, the counter weights will perform a figure of eight motion which will balance the rocking couple.

Figure 4:
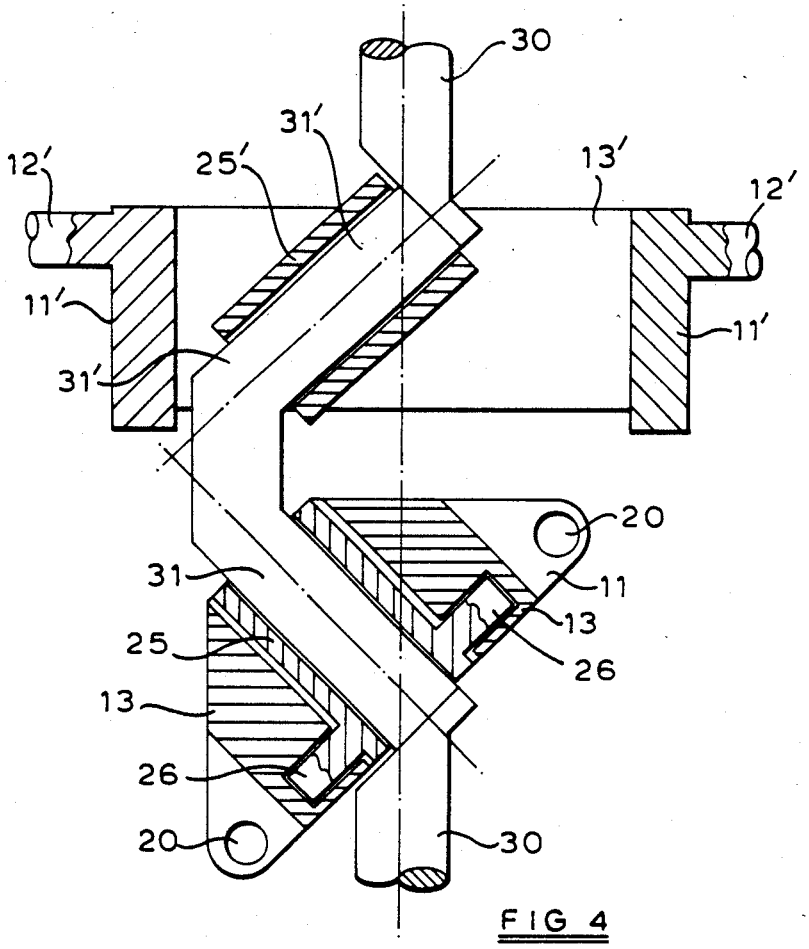
FIG. 4 is a part sectional view illustrating the beam/crank shaft assembly of an eight cylinder engine based on the engine illustrated in FIG. 1.

As the crank shaft 30 of the engine described above extends parallel to and centrally of the cylinders 14 in which pistons 15 are located, it is convenient to utilize rotary valves which are driven intermittently by means of a plate which is driven in orbital fashion by the crank shaft 30. Such valve gear arrangement is disclosed in UK patent application No. 8720494 and as illustrated in FIG. 4 comprises a plate 40 which is mounted on a crank 41 on crank shaft 30. The plate 40 is connected to four idler shafts 42 on cranks 43 which have the same throw as crank 41 and which constrain the plate 40 to be driven in orbital fashion, upon rotation of the crank shaft 30. The plate 40 is drivingly connected to the drive shafts 45 of rotary valves 46, one such rotary valve 46 being mounted in the head of each cylinder, the drive being transmitted to the rotary valve 46 by a linkage 47 of the form covered in UK patent application No. 8720494. The linkages 47 connect the valve drive shaft 45 to the plate 40 in appropriate phase relationship to provide the required timing with respect to the firing order of the cylinders. Typically, the firing order of the cylinders will be 14A:14C:14B:14D where cylinders 14A, 14B and 14C, 14D are on the same side of pivot axis of beams 11, respectively.

In the engine described above, because of the necessity of decoupling the movement of the crank 31 transverse to the plane in which the beams 11 rock, the torque transferred from the beams 11 to the crank shaft 30 will be substantially sinusoidal, being at a maximum when the pistons 15 are at the middle of their stroke and decreasing to a minimum at top dead centre and bottom dead centre. A substantially uniform torque transfer to the crank shaft 30 may be achieved by arranging two such banks of four pistons 15 back to back, the beams 11 of one bank being disposed at right angles to the beams 11' of the other bank, as illustrated in FIG. 4.

As illustrated in FIG. 4, the eight cylinder engine formed by combining two banks of four pistons has a crank shaft with a Z-crank defined by two crank pins 31 and 31', crank pin 31 being located in bearing 25 associated with one bank of pistons 15 and the other crank pin 31' being located in the bearing 25' associated with the other bank pistons 15'. In order to achieve this, the pistons 15 and 15' must be phased such that when the pistons 15 of one bank are at top dead centre or bottom dead centre, the pistons 15' of the other bank will be in the middle of their strokes. All eight pistons 15, 15' may consequently be arranged to fire sequentially.

With the eight cylinder engine described above, movement of the pistons 15 and 15' will induce a rotating couple. This couple may be balanced by counter weights on the crank shaft 30 or by means of the plates 40 which drive the rotary valves.

Figure 5:
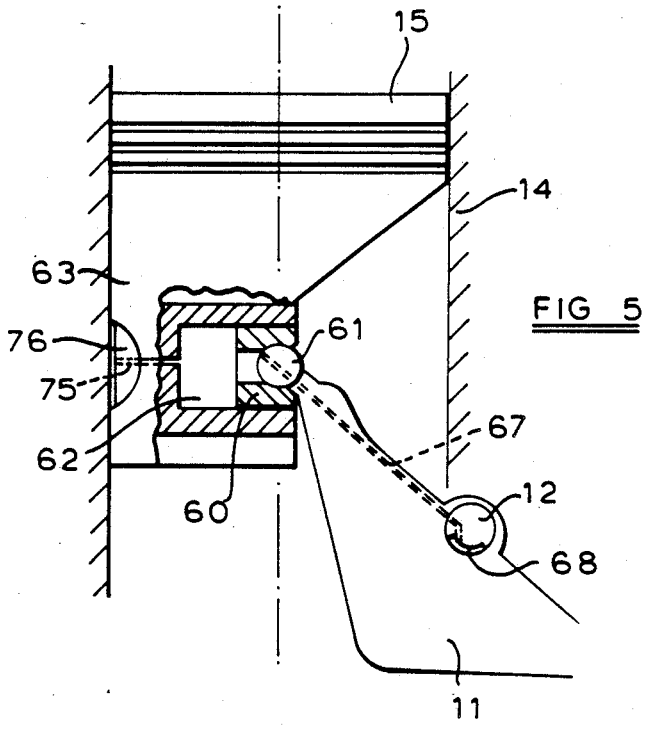
FIG. 5 shows a detail part sectional view illustrating an alternative method of connecting the pistons to the beams.

As illustrated in FIG. 5, instead of connecting the pistons 15 to the beams 11 by means of con-rods 17, a piston 60 may be connected to each end of each of the beams 11 by means of a ball joint 61. The piston 60 is then located in a closed cylinder 62 formed in the skirt portion 63 of piston 15, the cylinder 62 extending transversely of the direction of movement of piston 15. The beam 11 is dimensioned so that when the piston 15 is at top dead centre, the ball joint 61 will be located on the axis of piston 15, so that as the piston 15 moves down, the piston 60 will be displaced to the left (as illustrated) into the cylinder 62 until at the mid point of the stroke of piston 15, after which it will be displaced to the right until at bottom dead centre the ball joint 61 is again aligned with the axis of the piston 15. The skirt portion 63 of the piston 15 on the side adjacent pivot 12 of beam 11 is cut away to provide a clearance for the beam 11 when the piston 15 is at bottom dead centre.

Figure 6:
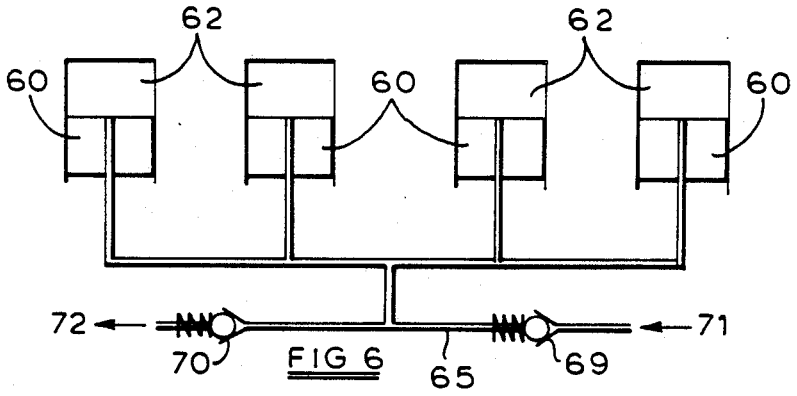
FIG. 6 illustrates an oil distribution system based on the modification illustrated in FIG. 5.

The cylinder 62 may be interconnected to similar cylinders on the other pistons 15 associated with the pair of beams 11 and with an oil line 65 (as illustrated in FIG. 6), by means of a passage 67 through the beam 11 and an arcuate circumferential groove 68 in the beam pivots 12. The connection to the oil line 65 is between a pair of non-return ball valves 69 and 70 which permit flow of oil from a reservoir 71 and to a delivery line 72. Upon movement of the piston 60 to the right, oil will consequently be drawn from the reservoir 71 into cylinder 62 past the ball valve 69 and on movement of the piston 60 to the left, oil will be forced from cylinder 62 past ball valve 70 into the delivery line 72. All the pistons 62 associated with the pistons 15 connected to a pair of beams 11 will act in unison.

As illustrated in FIG. 5, a capilliary bore 75 may be provided from the closed end of cylinder 62 to the wall of the piston 15. This capilliary bore 75 opens into a circular recess 76 in the piston wall which is equal in area to the piston 62. As piston 62 moves to the left, oil is forced through the capilliary bore 75 into the recess 76 to provide a hydrostatic balance pad which will balance the force applied to the piston 15.

In addition to pumping oil to the delivery line 62, oil under pressure may be bled off directly from the cylinder 62 to provide lubrication for the walls of the piston 15, the bearings of pivots 11 or of trunnions 26, etc.

Various modifications may be made without departing from the invention. For example, while a four stroke engine is described above, the engine configuration covered by the present application is applicable to two stroke engines. Also while rotary valve mechanisms are particularly suitable for this engine, other forms of valve gear, for example conventional poppet type valves, may be used.

I claim:

1. An internal combustion engine including a beam mounted on a central pivot, a pair of pistons each slidably located in a cylinder, each piston acting on an opposite end of the beam, said beam defining a cradle, a bearing being mounted within the cradle upon a pair of trunnions about which the bearing may pivot, the pivot axis of the bearing being at right angles to the pivot axis of the beam, said pivot axes lying within a common plane which is transverse to the axes of the cylinders, a crank shaft with angled crank pin being mounted so that its axis of rotation extends longitudinally of the cylinders and passes through the point of intersection of the pivot axes of the bearing and beam, the crank pin being located in the bearing.

2. An internal combustion engine according to claim 1 in which the cradle is defined by a pair of beams pivotted about a common axis and a pair of cross members interconnecting the beams, the trunnions being mounted in bearings upon the cross members.

3. An internal combustion engine according to claim 2 in which an individual piston is connected to each end of each beam.

4. An internal combustion engine according to claim 1 in which each piston is connected to its associated beam by means of a connecting rod which is pivotally attached at one end to the piston and at the other end to the beam.

5. An internal combustion engine according to claim 1 in which the piston is connected to the associated end of the beam by means which will permit relative movement thereof transversely of the direction of movement of the piston in its cylinder bore.

6. An internal combustion engine according to claim 5 in which a secondary piston is connected to the end of the beam by means of a ball joint, said secondary piston being slidably located in a transverse bore in the skirt portion of the main piston so that the secondary piston is able to move into and out of the transverse bore to accommodate relative lateral movement between the main piston and the beam.

7. An internal combustion engine according to claim 6 in which the transverse bore is connected to an oil line, so that upon movement of the secondary piston in the transverse bore, oil will be pumped from a reservoir to a delivery line.

8. An internal combustion engine according to claim 7 in which a bore connects the closed end of the transverse bore to a recess in the wall of the main piston, said recess being of substantially the same area as the secondary piston to provide hydrostatic balancing of the transverse forces applied to the main piston.

9. An internal combustion engine according to claim 1 in which each cylinder has a rotary valve, said rotary valve being driven by means of a plate which is mounted on a crank on the crank shaft, said plate being constrained to perform orbital motion and being connected to the rotary valves by means which will transmit the orbital motion of the plate to the drive shaft of the rotary valve.

10. An internal combustion engine according to claim 1 in which counter weights are provided on both sides of the bearing, the centre of mass of the weights being disposed on an axis mutually perpendicular to the axis of the trunnions and the axis of the crank to balance the rocking motion induced by movement of the pistons.

11. An internal combustion engine in which two assemblies as claimed in claim 1 are disposed back to back, with one beam assembly disposed at 90° to the other, the two beam assemblies being interconnected by a common crank shaft, the crank shaft having a Z-crank which defines two bearing pins which are located in the bearings associated with each of the beam assemblies.

12. An internal combustion engine according to claim 11 in which counter weights are provided on the crank shaft to balance the rotational couple induced by movement of the two sets of pistons.

13. An internal combustion engine according to claim 11 in which the set of cylinders associated with each assembly is provided with rotary valves, the valves associated with each set being driven by a plate which is mounted on a crank on the crank shaft and is constrained to move in orbital fashion, said plates being arranged to balance the rotational couple induced by movement of the pistons.

* * * * *